US008631555B1

(12) United States Patent
Favale

(10) Patent No.: US 8,631,555 B1
(45) Date of Patent: Jan. 21, 2014

(54) SEALING SHRINK WRAP MACHINE

(71) Applicant: Dennis Favale, Addison, IL (US)

(72) Inventor: Dennis Favale, Addison, IL (US)

( * ) Notice: Subject to any disclaimer, the term of this patent is extended or adjusted under 35 U.S.C. 154(b) by 0 days.

(21) Appl. No.: 13/850,586

(22) Filed: Mar. 26, 2013

(51) Int. Cl.
*B21D 39/00* (2006.01)

(52) U.S. Cl.
USPC ..... 29/525.01

(58) Field of Classification Search
USPC ..... 29/525.01; 53/201, 393
See application file for complete search history.

(56) References Cited

U.S. PATENT DOCUMENTS 6,629,400 B1 * 10/2003 Offermann et al. ..... 53/374.6
6,854,242 B2 * 2/2005 Stork et al. ..... 53/53
6,907,711 B2 * 6/2005 Ishii et al. ..... 53/54
7,775,019 B2 * 8/2010 Haak et al. ..... 53/389.2
2007/0022715 A1 * 2/2007 Wegner et al. ..... 53/396
2007/0163208 A1 * 7/2007 Scholte ..... 53/393

* cited by examiner

*Primary Examiner* — Jermie Cozart
(74) *Attorney, Agent, or Firm* — Knechtel, Demeur & Samlan

(57) ABSTRACT

There is provided a method for manufacturing and shipping a multi-station packaging machine to an ultimate customer by manufacturing the machine as individual modules, each of which has a weight limitation not exceeding 35 pounds and a size limitation not exceeding 24 inches in length, 18 inches in height and 24 inches in width. Each module is manufactured with disengageable engagement means to permit the modules to be easily interconnected into a working packaging machine, and individualized custom power supply connectors to insure proper power supply to each of the modules requiring power.

6 Claims, 5 Drawing Sheets

15
16
18
19
20
21
23
24
25
26
28
29
30
31
32
33
35
36
37
39
41
42
43
44
45
46
50
51

SEALING SHRINK WRAP MACHINE

BACKGROUND OF THE INVENTION

The present invention is directed to a modularized multi-station plastic film shrink wrap machine wherein each of the individualized component stations of the machine have a weight limitation of thirty-five pounds and size limitations of 24 inches in length, 18 inches in height and 24 inches in width. This feature permits the machine to be sold and shipped to the purchaser as individual packages by way of ordinary mail or package delivery systems and easily assembled by the purchaser into a useable shrink machine. The advantages achieved include the avoidance of expensive freight charges, ease of assembly, and ease of replacing any one of the stations should repairs or replacement be necessary.

Typically, plastic film shrink wrap machines are generally composed of a five station machine which is built as a unitized piece of equipment. The machine generally includes a roller stand which contains at least 2 rollers to accommodate the plastic film for wrapping the package. This is generally mounted at one end of the machine. A package tray is adjacent to the film rolls, and forms a support surface upon which the operator places a package to be shrink wrapped. The film is then taken from the rollers adjacent to the package tray, and placed about the package. The operator then moves the package to the next station which consists of a heat seal bar arrangement wherein the operator manipulates the seal bar by usually pulling the bar down to heat seal the edges of the film around the package. The package is then moved onto a conveyor which moves the package into a heat tunnel which causes the film wrap about the package to be shrunk to the sizing of the package. The package then exits the heat tunnel via motorized rollers, then is further processed for packaging.

Generally, the manufacturing process of producing a shrink wrap machine is to first provide a solid firm base usually formed of metal. The various component parts of the machine are then mounted and fixedly secured to the base. Generally, the film rollers are mounted at one end of the machine, and then adjacent to the film rollers is the package tray which provides a station for the operator to place a package to be wrapped. Once the film is placed about the package, the next adjoining station is usually the heat sealing bar. The operator will then move the package with the film enveloping the package from the package tray to the heat sealing station. The operator then manipulates the heat sealing bar by pulling the bar down in order to heat seal the edges of the film which is now encircling the package. The next station is then the heat tunnel which is secured to the frame adjacent to the heat seal bar station. The package has a certain predetermined dwell time traveling through the heat tunnel which is predetermined in order to provide sufficient heat to cause the film to shrink wrap about the package. The rollers then move the package from the heat tunnel out of the far end of the tunnel, to an ultimate package destination station. Typically, the machine is formed of metal, and the various components are either welded on or bolted to the frame. Once the manufacturer of such equipment completes a machine, and the machine is sold, the machine is then palletized, and placed aboard a freight liner for delivery to the customer.

It will be appreciated that once the machine is fully constructed the weight is several hundred pounds or more. The weight of course, is dependent upon the material which is utilized to manufacture the machine, but typically, such materials are either steel or heavy grade aluminum.

The prior art shows various embodiments of shrink wrap machines of this type. For example, U.S. Pat. No. 6,854,242 shows what is considered to be a modular shrink wrap machine, however, it will be observed from the drawings and a reading of the description that the machine is basically formed on a frame 32, which supports the conveyor and the other stations including the film dispensing station 36, conveyor 42, and the like. As is indicated in the aforesaid patent, some components of the machine are modularized components', however, the machine as a whole is not modularized.

It is further well known in the art that a typical use for such machines is for shrink wrapping a variety of packages such as soft drink cans, for example see patent publication 2010/0236196, or other segregated or individualized packages such as shown in U.S. Pat. No. 6,629,400. It will therefore be appreciated that such types of machines tend to be rather large and heavy for the reason that the items to be shrink wrapped are generally bulky and require significant space and power for conveyors, or work stations.

However, the prior art has failed to recognize that there are a number of uses for such machines which are scaled down for smaller sized packages, and even with such applications, the machines still tend to be unitized in that they are built on a frame and all of the appropriate stations are either welded to or bolted to a frame. Hence, even machines intended for small size packaging operations tend to be bulky and heavy.

A further difficulty noted with prior art machines is that when the machine requires repair or service in the field, and either a service personnel must be transported to the site of the machine in order to repair the same, or the entire machine must be palletized and freighted back to the manufacturer for repairs. Either of such operations is costly and time consuming. The present invention therefore is directed to a fully modularized shrink wrap machine which is adapted for ease of assembly and disassembly.

The present invention provides a method for manufacturing a multi-station packaging machine by manufacturing the machine as individual modules, each of which modules has a weight limitation and a size limitation. The weight and size limitation is dicated by the limitations set by postal and non-freight package delivery systems. In this manner, the entire multi-station machine may be shipped in individual packages via a non-freight delivery system thereby avoiding costly freight charges.

The present invention further provides a method whereby the individual modules of the machine are provided with disengageable engagement means permitting the recipient of the machine to easily and quickly assemble the modules into a working machine. The invention further provides a method for providing each module requiring power with individualized custom power supply ports with custom power connectors such that proper electrical connections may be established for each module and avoid any mis-connections.

Further, should any one of the stations require repair or replacement, the user may easily disassemble the machine to remove the defective station and return the station to the manufacturer via postal or non-freight delivery systems. Hence, the expense of sending an on-site repair engineer or the expense of palletizing and freighting the entire machine back to the manufacturer is avoided. Similarly, the manufacturer may easily re-ship a replacement station to the user which may be quickly and easily re-assembled into the machine allowing the user's production process to continue.

OBJECTS AND ADVANTAGES

It is therefore the principal object of the present invention to provide a method for manufacturing and shipping a multi-station packaging machine by manufacturing each station as an individual module, each module having disengageable engagement means to permit each module to interconnect with the next adjacent module, and each module requiring a power source having an individualized custom power connector and power receptacle so that the correct power supply is established for each module.

A further object of the present invention is to provide a method for manufacturing and shipping a multi-station packaging machine by manufacturing each module as a separate module, each module having a size and weight limitation as dictated by postal and non-freight package delivery systems.

In conjunction with the foregoing object, it is a further object of the present invention to provide a method of manufacturing and shipping a machine as set forth above wherein the size limitation for each module is no larger than 24 inches in length, 18 inches in height and 24 inches in width, and the weight limitation is no greater than 35 pounds.

A further object of the present invention is to provide a method of manufacturing and shipping a machine as set forth above, wherein each module requiring a power supply is manufactured with an individualized custom power receptacle which will accept only an individualized custom power connector whereby only a correct power supply connection may be established for each module.

These and other objects and advantages will be best understood by reference to the accompanying drawings and specifications.

BRIEF DESCRIPTION OF DRAWINGS

With reference to the drawings, the following descriptions pertain:

FIG. 4*a* is a detailed view taken from FIG. 4 showing a slide rail slot and rail engagement means for slidably engaging one component to the next in order to accomplish engagement and disengagement thereof;

DETAILED DESCRIPTION OF DRAWINGS

Figure 1:
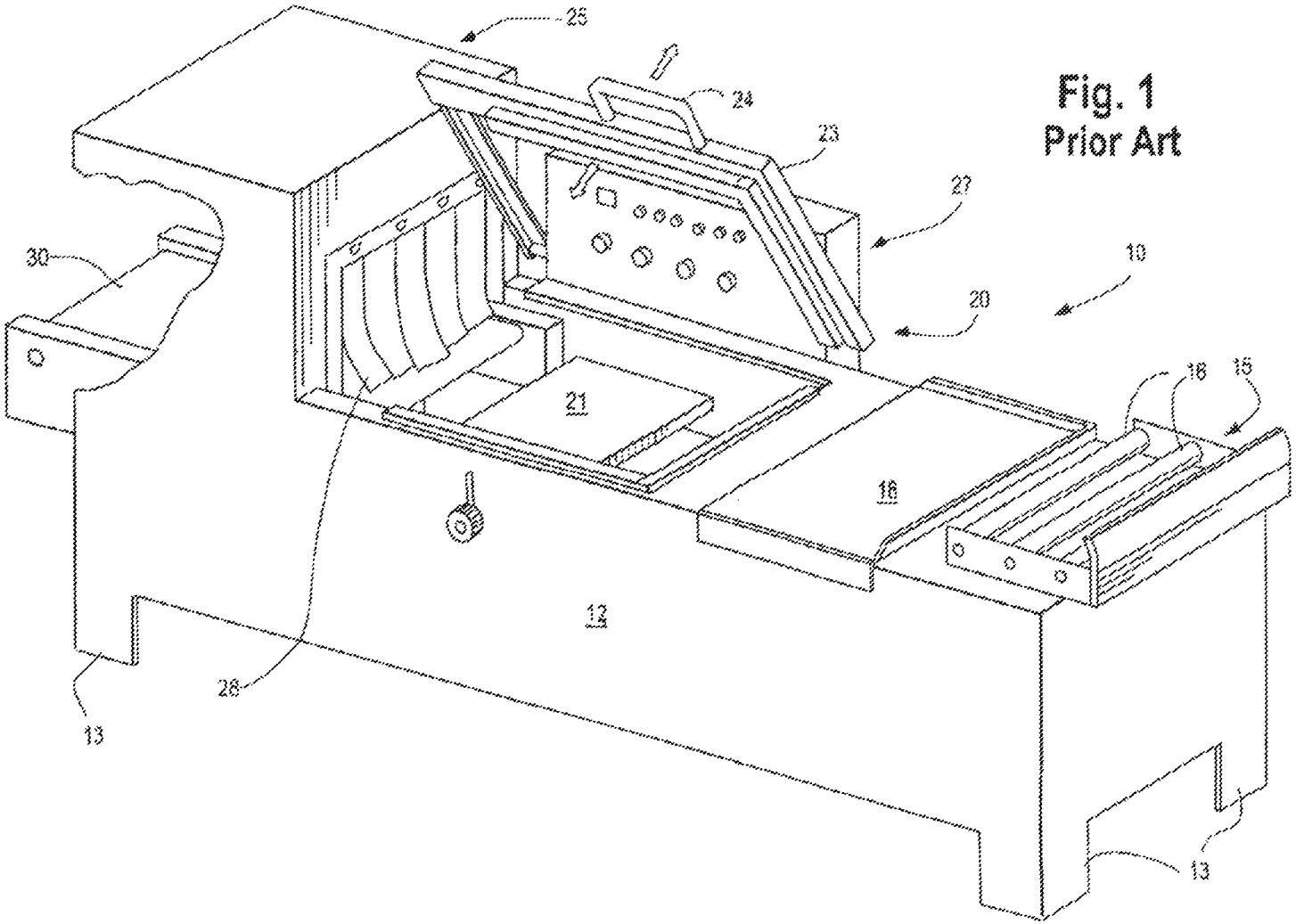
Fig. 1 Prior Art
FIG. 1 is a perspective view of a typical prior art shrink wrap machine which includes all of the components required in the shrink wrap machine which are typically carried on a frame, carrying all five components which are either welded or bolted to the frame.

With reference to FIG. 1, a typical prior art style shrink wrap machine is illustrated. The shrink wrap machine 10 generally is built on a frame 12 which includes a plurality of legs 13 suitable for positioning the machine 10 in place at the users facility. The shrink wrap machine 10 generally includes a series of five stations. The first station is film stand 15 which usually includes rollers 16 which accommodate a shrink wrap film roll to be mounted thereon. As shown in FIG. 1, two or more rollers 16 may be provided, each of the rollers carrying a roll of shrink wrap film as is typical. In this manner, the film from one roll may be moved to a position underneath the package to be shrink wrapped, while film from the second roll is moved over the top of the package to be shrink wrapped in a manner commonly known in the art. The second component consists of the loading tray 18 which provides a support surface for positioning the package to be shrink wrapped thereon. In typical fashion, the operator will move a portion of the shrink wrap film onto the loading tray after which the package is positioned on top of the lower film, and then moves a film from the second roller over the top of the package to be shrink wrapped. Again as is typical for such machines, the loading tray 18 may be adjustable so that it can be adjusted to accommodate different size packages to be shrink wrapped. In operation, once the package to be packaged has the film positioned about the package, it is then moved to the next station which consists of the seal bar station 20. The seal bar station includes an adjustable platform 21 where the operator will place the package when it is moved from the loading tray 18 to the seal bar station 20. The adjustment platform 21 is provided in order to accommodate differently sized packages thereon. A seal bar 23 is provided which, in typical fashion, includes a heating element located throughout the seal bar, such that when the operator manipulates the seal bar 23 by pulling it downwardly, the heating element in the seal bar 23 will heat and weld the shrink wrap film together about the package. This is accomplished by the operator grasping the handle 24 in order to pull the seal bar 23 downwardly. Once the edges of the shrink wrap film have been sealed by the seal bar 23, the package is then moved into the next station consisting of the heat tunnel 25. As is well known in the art, the heat tunnel 25 includes a source of heat which is controlled by the main electrical control panel. In order to contain the heat within the heat tunnel 25, a series of containment curtains 28 form the entryway into the tunnel 25. It is further well known in the art, the base of the heat tunnel 25 includes a plurality of rotating rollers (not shown) which move the package through the tunnel on a predetermined speed, permitting the heat within the heat tunnel 25 to fully shrink wrap the film about the package being packaged.

Finally, the shrink wrapped package then exits from the heat tunnel via the last station being the exit rollers 30. Typically, the exit rollers 30 are similarly powered by the control panel 27 in order to move the shrink wrapped package out of the tunnel and to a delivery container, tray or other end point depository.

The control panel 27 also includes the power source for the heating element in the seal bar 23, such that all of the stations of the machine requiring power have one central control panel 27 to provide power thereto. Again, typically in prior art machines, the wiring from the control station 27 to each of the multiple stations requiring power is done by hard wiring which extends from the control box to each of the stations such as the seal bar 23, heat tunnel 25, and the exit rollers 30.

It would be appreciated from a view of FIG. 1 of the drawings that once the machine is constructed as illustrated, in order to transport the machine to the ultimate user or customer, the machine is palletized (mounted to a pallet) and transported via freight shipment. This usually requires transportation via a freight line, and also requires that the palletized machine be placed onto a freight liner via a forklift truck or other such material handling equipment. Once the machine reaches its ultimate destination, once again, it must be removed from the freight liner by a forklift truck or other type of material handling equipment in order to be moved into position to be used by the customer.

Figure 2:
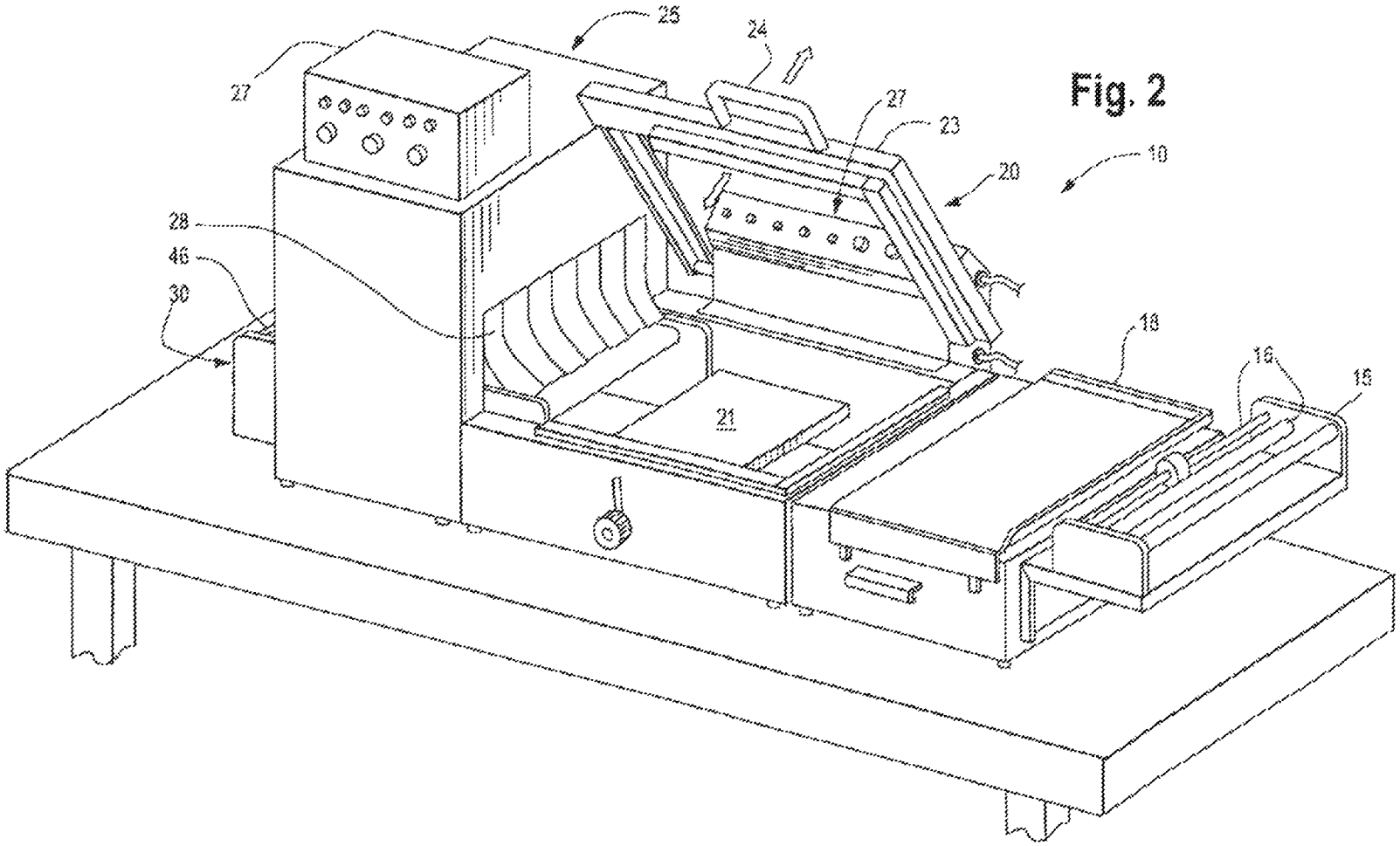
FIG. 2 is a perspective view of a modularization of a shrink wrap machine in accordance with the present invention.

From a view of FIG. 2, it will be observed that the present invention now consists of providing the machine 10 in a modularized fashion. As is shown in FIG. 2, each of the stations is provided as an individual modularized unit. The film stand 15 which includes roller 16 is shown to be an individualized or modularized unit. The film stand 15 may be interconnected with the next adjacent station, the loading tray station 18, by means of engagement means to be described more fully hereinafter. The loading tray station 18 is in turn engaged to the seal bar station 20 again by the use of disengageably engagement means. The seal bar station 20 is once again interconnected with the heat tunnel 25 by disengageable engagement means, and finally, the exit rollers 30 are contained within the unit which is mounted to the back end of the heat tunnel station 25. The control panel 27 is shown, in this embodiment to be mounted rearwardly of the seal bar station 20 although it is contemplated that the control panel 27 may be positioned in any one of the various stations so long as it is fully contained on the one station.

FIG. 2 also illustrates that the entire frame 12 may be eliminated from the shrink wrap machine 10 permitting each of the 5 components to be disengageably engaged together on any table top surface as may be desired by the customer. In this manner, a great deal of weight and excess material is eliminated from the machine. Further, it will be appreciated that if any one component of the machine should be in need of service or replacement, the entire machine need not be shipped back to the manufacturer. The component requiring repair or service, may be disengageably removed from the adjoining components, and may be easily shipped back to the manufacturer via an ordinary package delivery system for repair or replacement. This eliminates the need for major freight expense or the alternative, the expense of providing a service personnel to be put into the field in order to engage in repair and service for a malfunctioning machine.

Another advantage to the modularization of the machine is the fact that it is well known that certain customers only require shrink wrapping equipment for a seasonal packaging experience. For example gift baskets and the like used for seasons such as Christmas, Easter and the like are packaged only for the season, and hence, when the season ends, there is no further need to have the shrink wrap equipment in position. In this manner, once the seasonal packaging has terminated, the machine may be easily disassembled and conveniently stored by stacking the various components in a very small amount of space.

Figures 3, 3A, 3B, 3C:
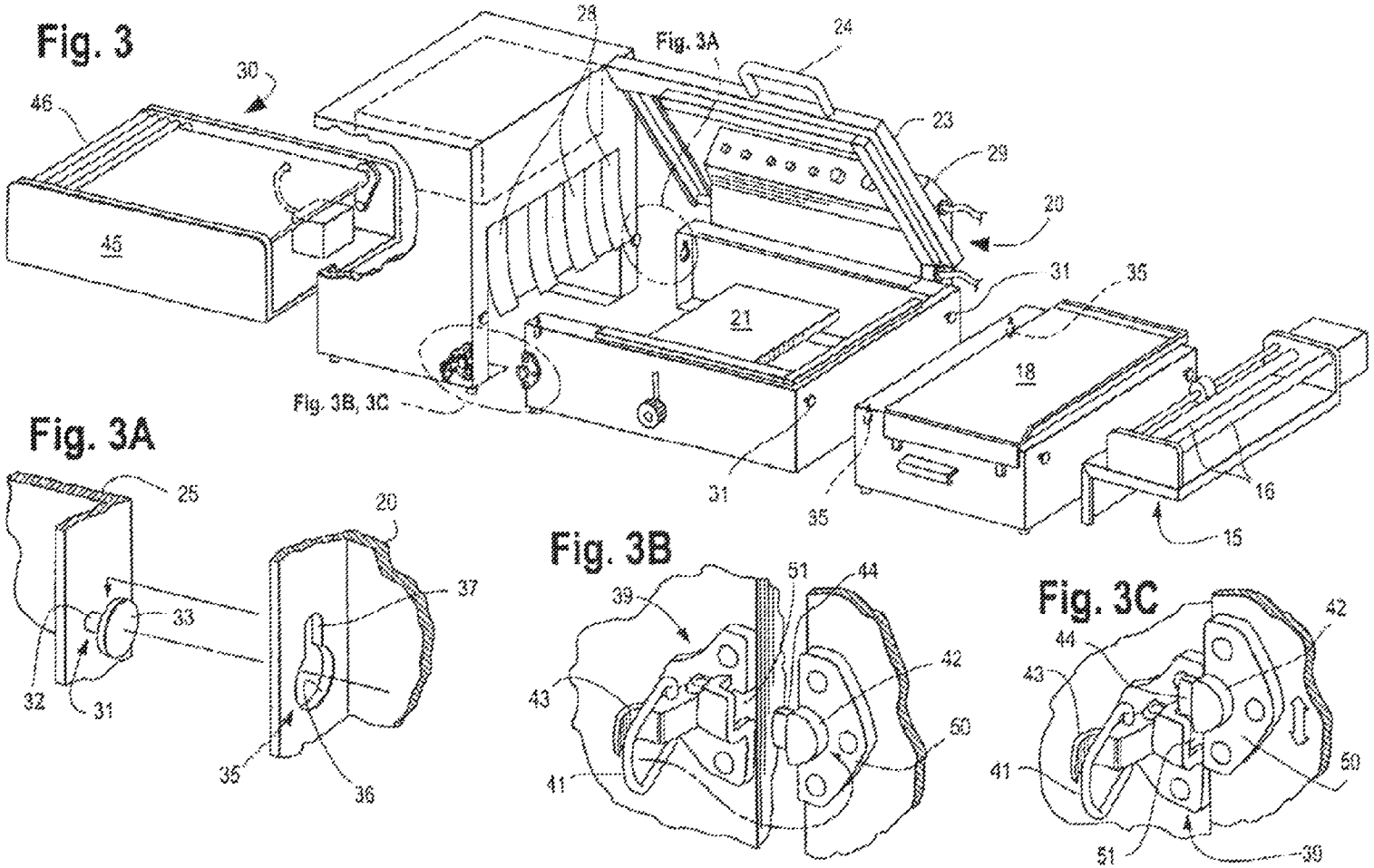
FIG. 3 is a perspective exploded, partly in cross section, showing the various components of a shrink wrap machine in accordance with the present invention illustrating the manner of assembly and disassembly of one component to the next.
FIG. 3*a* is a exploded view, partly in cross section, showing engagement means consisting of a button head, and key slot arrangement taken from the exploded view of FIG. 3.
FIG. 3*b* is a side elevational view taken from the exploded view of FIG. 3, showing a swing latch engagement means for disengagebly engaging one component to the next.
FIG. 3*c* is a side elevational view taken from the exploded view of FIG. 3, showing swing latch engagement means for disengageable engaging one component to the next where in the slot in which the locking tongue slides includes an open top end for ease of assembly.
Figure 4:
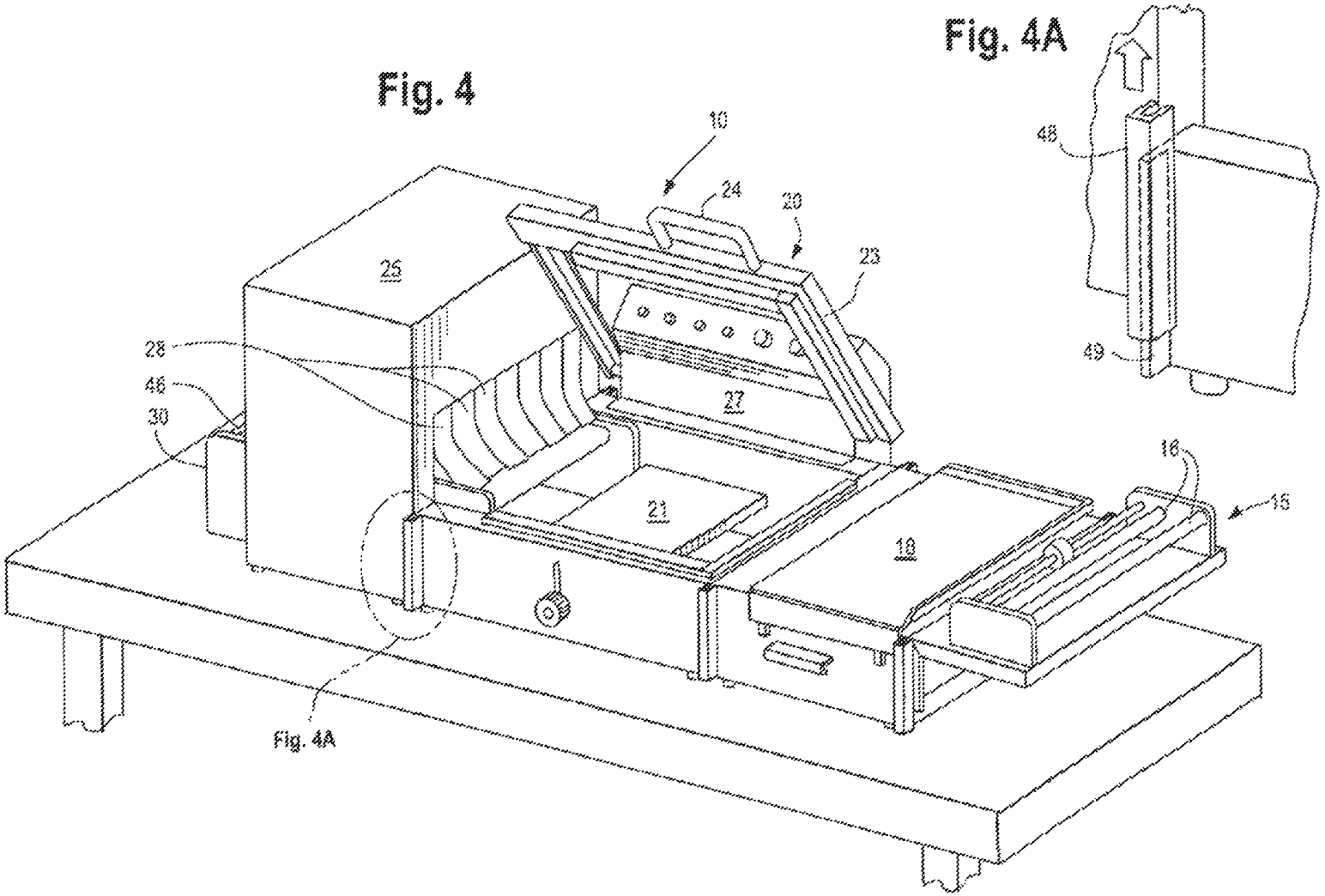
FIG. 4 is a perspective view of the modularized shrink wrap machine of the present invention showing still another alternative means for engaging one component to the next.

FIGS. 3 and 4 of the drawings, illustrate the various disengageable engagement means which may be employed in order to accomplish the modularization of the shrink wrap machine 10 of the present invention. With specific reference to FIGS. 3, 3*a*, 3*b* and 3*c*, two different formats for disengageable engagement means are illustrated. FIG. 3*a* illustrates one form of engagement means which permits an easy and quick assembly procedure. As shown in FIG. 3*a*, the engagement means may consist of a steel stud 31 mounted on the wall of one component such as heat tunnel 25, while the adjoining component, the heat sealing bar station 20, includes a key slot 35 formed in the wall thereof. The steel stud 31 is formed by a lateral bar 32 and terminates in a round head 33. The key slot 35 is formed by a round head receptor aperture 36 which is co-extensive with a lock slot 37. It will be appreciated that the engagement occurs by inserting the round head 33 through the head receptor aperture 36, and then allowing the unit having the key slot 35 to slide downwardly such that the lateral bar 32 slides into the lock slot 37 locking the round head 33 behind the head receptor aperture 36. As shown in FIG. 3, each adjoining station may include either a pair of such stud 31, key slot 35 engagement means or may include a series of four such elements in order to positively lock one unit to the next adjoining unit.

FIG. 3*b* illustrates another form of a locking mechanism to accomplish the disengageable engagement of one component relative to the next adjoining component. As shown in FIG. 3*b*, the lock means may consist of a swing latch 39 which includes a lock bar 41 which is pivotally carried on the swing latch 39. The other portion of the lock consists of a lock bar receiving ledge 42 which receives the lock bar 41 therein. Once the lock bar 41 is received in the lock bar receiving ledge 42, a pull latch 43 is moved rearwardly to lockingly engage the lock bar 41 in the ledge 42. This type of latch is commonly known and employed in many closing mechanisms for devices such as suitcases, or other such devices. Once again, the swing latch assembly may be employed on opposing sides of each component so each component may be lockingly engaged to the next adjoining component.

As further shown in FIG. 3*b*, positive locking occurs when the male tongue 44 of latch portion 50 is inserted into the tongue receptor 51 of swing latch 39.

FIG. 3*c* illustrates a still further refinement of the latch assembly of FIG. 3*b*. In this embodiment, the swing latch 39 is shown to have an open slot forming the top of the tongue receptor 51 such that the tongue 44 may be simply set down into the tongue receptor 51 after which the pull latch 43 is pulled rearwardly to lock the lock bar onto the lock receiving ledge 42.

As shown in FIG. 3, the exit rollers 30 may be formed by a roller box 45 which carries a plurality of rollers 46 on the top surface thereof. The box 45 may be sized so that it slidingly engages into the tunnel 25 and is sized in order accept the package being transmitted through the heat tunnel 25 in a manner so that the rollers 46 are in alignment with the base of the heat tunnel 25 such that the package is easily rolled through the tunnel 25 onto the rollers 46 exiting the machine. Once again, once the roller box 45 is slidingly engaged into the tunnel 25, appropriate latches may be provided to lockingly engage the roller box 45 into tunnel 25.

FIGS. 4 and 4*a* illustrate still another embodiment of disengageable engagement locking means for lockingly engaging adjoining components of the machine together. As shown in FIG. 4*a* specifically, the locking means may consist of a rail slot 48, formed on the wall of one of the components such as heat tunnel 25, and a rail 49 formed on the wall of an adjoining component such as heat sear bar station 20. Engagement would be accomplished by lifting the one component and sliding the rail 49 into the rail slot 48 thereby locking adjoining components together. As shown in FIG. 4*a*, the rail slot 48 is shown extending outwardly from the wall of the component, and rail 49 similarly outwardly from the wall of the component. However, it is contemplated that the rail slot 48 may be formed as an indentation in the side wall of the one component, and the rail 49 formed as an indented rail in the side wall of the adjoining component such that there are no lateral projections of the rail slot and rail arrangement.

Figure 5:
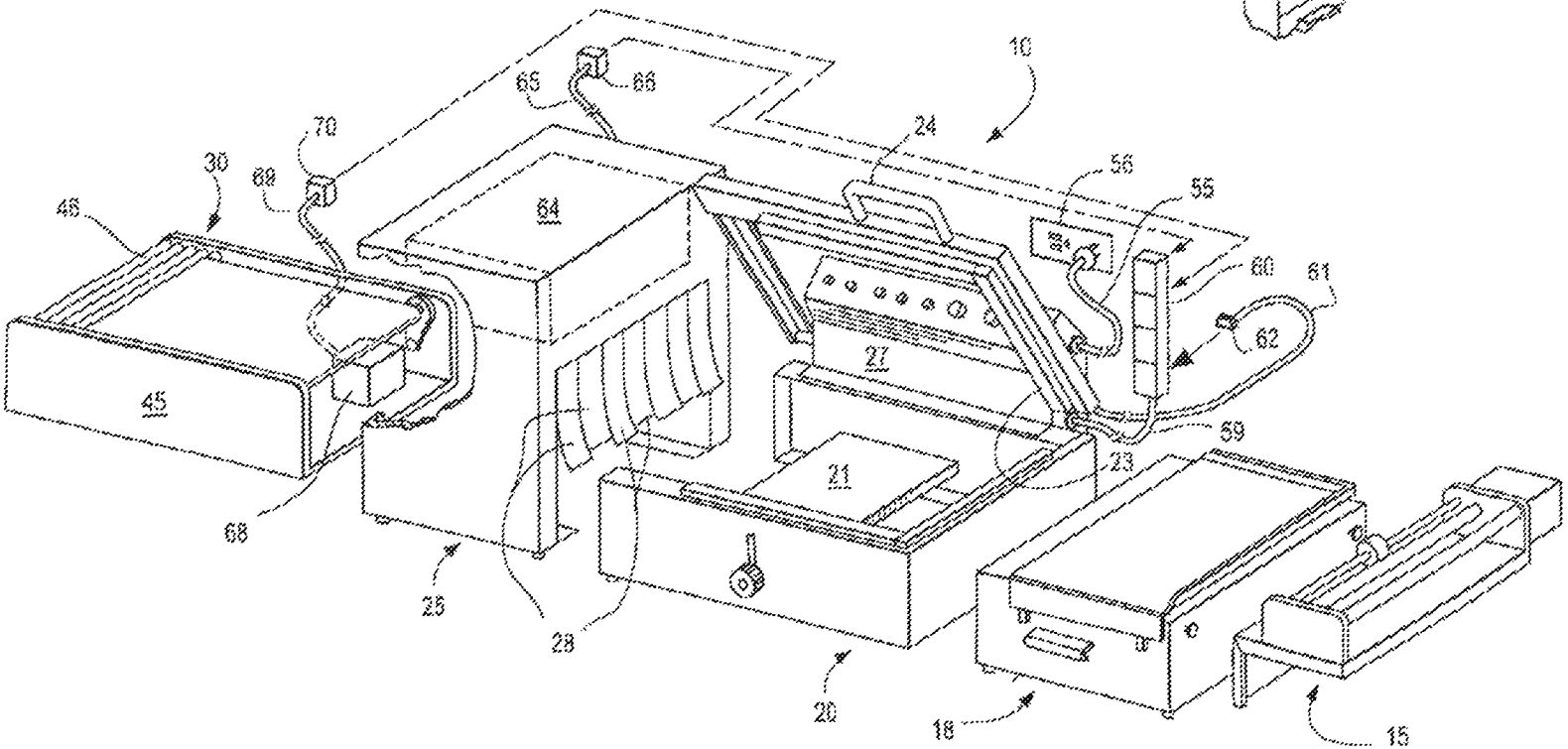
FIG. 5 is a perspective exploded view, partly in cross section, showing the quick connects and disconnects for providing an electrical power source to each of the components requiring a power source.

A further feature of the invention pertains to the method by which power is supplied from the main electrical control panel 27 to the various components requiring a power source. It is generally known that a shrink wrap machine of the type described herein and above generally requires a power source for at least three of the five components. These include the heat sealing station 20, which requires a power source for heating the sealing wires within the sealing bar 23, the heat tunnel 25, which requires a source of power in order to provide a heat source for heating the shrink wrap film which envelops the package traveling through the heat tunnel 25, and the exit rollers 30 which are generally powered by a motor in order to move the package through the exit portion of the machine. The main electrical control panel 27 is therefore provided with a main power cord 55 which is usually plugged into a 110 volt wall receptacle 56. With specific reference to FIG. 5, once again, the modularized shrink wrap machine 10 is shown in its exploded view. It will be observed that 3 of the components do in fact require power. This would include the heat seal bar station 20, which requires a source of power for the seal bar 23 in order to heat the seal wires contained within the bar 23. The sealing wire is heated by the power source in order to seal the edges of the shrink wrap film which are encircled about the package which is placed within the station 20. It will be observed the main electrical control panel 27 is provided with a receptacle cord 59 which carries single receptacle box 60. The sealing bar 23 is provided with power cord 61 terminating in a male plug 62. Similarly, the heat tunnel 25 includes the heater 64 which requires a source of power in order to provide heat to the heat tunnel 25. The heater 64 is shown to include a power cord 65 which terminates in a male plug 66. The exit rollers 30 similarly requires power and is therefore provided with a motor 68 which has a power cord 69 extending therefrom terminating in a male plug 70. It will be appreciated that each of the plugs 62, 66 and 70 may be plugged into the receptacle box 60 of the main electrical control panel 27. Hence, in assembling the subject modularized shrink wrap machine, once the various components are engaged together, the plugs 62, 66 and 70 are plugged into the receptacle box 60 of the main electrical control panel 27, thereby energizing the machine once the electrical control panel 27 is plugged into a power source via the wall receptacle 56. Hence, by providing quick disconnects for each of the components requiring a source of electrical power, once again, the assembly of the machine has been simplified. Further, it is contemplated that each of the plugs 62, 66 and 70 would have particular characteristics which would match only a certain female receptacle in the receptacle box 60 such that the assembler of the machine can make no mistakes as to which plug goes into which receptacle. These such types of quick disconnects are well known in the art.

Figure 6:
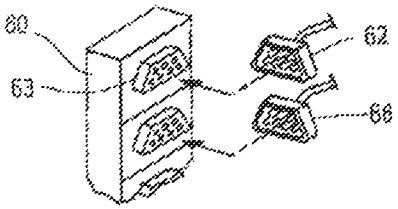
FIG. 6 is an elevational view showing the male and female quick disconnects providing a quick connect method for providing a source of electrical power to each component so requiring.

FIG. 6, one embodiment of male and female plugs is illustrated. As shown therein, the receptacle box 60 will be provided with a series of individualized female receptacles 63 which would accommodate a particular male plug 62 and 66, for example, by having the appropriate female receptacle 63 configured so that only one of the male plugs will fit into receptacle 63. This can be accomplished by either the manner of configuring each of the plugs separately, or by providing each plug with a certain predetermined series of male pins which will only fit into one of the receptacle 63. In this manner, the assembler of the machine is prevented from making any mistakes as to which receptacle will accommodate which of the plugs therein.

The important feature of the present invention is a method for manufacturing and shipping a packaging machine in a manner which eliminates costly shipping expenses while at the same time simplifies the process of repair or replacement of various components of the machine when a break-down occurs. Hence, in order to utilize the less expensive package delivery systems available, such as United Parcel Service, the U.S. Post Office, Federal Express, or others, the weight and size limitations imposed by those systems must be observed.

It has been determined that a weight limit of 35 pounds is imposed. Therefore, incident to the manufacturing method employed herein, each of the component modules must be manufactured with a weight of 35 pounds or less. This is accomplished by selecting the proper materials including metal components and electrical components such that each module does not exceed the weight limitation.

Similarly, the existing package delivery systems impose a size limitation so that the package can be handled by the delivery system. It has been found that a size limitation of 24 inches in length, 18 inches in height and 24 inches in width will result in a package that meets the size limitations imposed by the package delivery systems. Hence, by manufacturing each module with these size limitations, the entire machine may be manufactured and shipped as separate packages to the ultimate customer. The recipient then simply interconnects the modules together on an underlying support surface and connects the necessary power supply connectors and ports. In this manner, the recipient is assured that each module is receiving the proper amount of power to operate the machine.

A further advantage to the method of the present invention relates to the ease with which repairs and replacement of defective or damaged components may be addressed. It will be appreciated that in the event any one of the modules experiences problems, that particular module may be disengaged from the machine and shipped back to the manufacturer in exchange for a replacement module, again utilizing the same package delivery system. This avoids the costly expense of palletizing and freighting the entire machine back to the manufacturer, or in the alternative, requiring that a repair engineer be sent to the machine site to effect repairs.

While the present method of the invention has been described in connection with the manufacturing a shrink wrap machine, it will be appreciated that other types of multi-station machine may employ the method described herein to simplify shipping and repair concerns.

It will therefore be appreciated that in accordance with the present invention, a method for manufacturing and shipping a multi-station packaging machine has been described. This method simplifies and reduces the expense of shipping the machine to the recipient and further simplifies and reduces the expense associated with repairs and replacement of damaged or defective components.

While there has been described what are considered to be the preferred embodiments of the invention, various modifications may be made therein all which are intended to be covered by the scope of the appended claims.

The invention claimed is:

1. A method of manufacturing and shipping a multi-station packaging machine comprising the steps of:

manufacturing each station of a multi-station packaging machine as a separate module, each module provided with disengageable engagement means to permit each module to be disengageably engaged to the adjoining appropriate module, manufacturing each module to have size dimensions not exceeding 24 inches in length, 18 inches in height and 24 inches in width and each module having a weight of not exceeding 35 pounds, providing one of said modules with a main power supply having connection means for connecting to a power source and further provided with separate power supply ports for providing power to each module requiring a power supply, each of said separate power supply ports being individualized such that each power supply port can service only a specific module for which power is required, whereby, each station of said multi-station packaging may be manufactured and shipped as a single unit thereby permitting the entire multi-station packaging machine to be shipped via non-freight delivery methods and easily assembled by the recipient of the machine.

2. The method as set forth in claim 1 above, wherein each module requiring a power supply is provided with an individualized custom power supply port adapted to receive a customized power cord connector whereby only one appropriate power cord may be accepted into said power supply port in order to avoid any mis-connections.

3. The method as set forth in claim 2 above, wherein each module requiring power is provided with a power cord for interconnecting between said main power supply and said module, each of said power cords being provided with an individualized custom male power connector adapted to be received in a corresponding individualized custom female receptor port in order to avoid any mis-connections.

4. The method as set forth in claim 3 above, wherein each of power cords is provided with quick connect and disconnect means to facilitate ease of assembly and disassembly.

5. The method as set forth in claim 1 above, wherein said disengageable engagement means comprises the combination of a swing latch having a lock bar pivotally carried thereon on one module and a lock bar receiving ledge on the adjacent module thereby to lockingly engage one module to the next adjacent module.

6. The method as set forth in claim 1 above, wherein said disengageable engagement means comprises the combination of a steel stud mounted on one module and a key slot mounted on the adjacent module, the steel stud adapted to be received in the key slot to lockingly engage one module to the next adjacent module.

* * * * *